US005083838A

United States Patent [19]

Maxwell, Jr.

[11] Patent Number: 5,083,838

[45] Date of Patent: Jan. 28, 1992

[54] SEATING CLUSTER FOR AIRPORT WAITING AND SIMILAR AREAS

[76] Inventor: Joseph A. Maxwell, Jr., 100 Phillips Knob, Burnsville, N.C. 28714

[21] Appl. No.: 583,037

[22] Filed: Sep. 14, 1990

[51] Int. Cl.[5] ..... A47C 15/00

[52] U.S. Cl. ..... 297/244; 297/232

[58] Field of Search ..... 297/232, 248, 249, 135, 297/170, 121, 243, 244; 108/63; D6/335, 337

[56] References Cited

U.S. PATENT DOCUMENTS

| | | | |
|---|---|---|---|
| D. 150,247 | 7/1948 | Nichols | 297/248 |
| D. 196,121 | 8/1963 | Soszynski | D6/337 |
| D. 212,534 | 3/1966 | Borenstein | D6/335 |
| D. 272,302 | 1/1984 | Connelly | D6/337 |
| D. 280,367 | 9/1985 | Reomer, Jr. | D6/337 |
| D. 297,449 | 8/1988 | Vigil | D6/335 |
| 2,845,110 | 7/1958 | Growl | 297/121 |
| 2,914,115 | 11/1959 | Cameron | 297/248 |
| 3,002,787 | 10/1961 | Ziegenfuss | 297/249 |
| 3,347,593 | 10/1967 | Walkinshaw | 297/248 |
| 4,248,477 | 2/1981 | Netters | 297/135 |

FOREIGN PATENT DOCUMENTS 534671 10/1955 Italy ..... 297/135

OTHER PUBLICATIONS

*Interiors*, Jul. 1989, p. 131—Flooring: Iberia Cerdisa.

*Domus*, Jan. 1985, p. 68.

*Primary Examiner*—Kenneth J. Dorner

*Assistant Examiner*—Cassandra Hope

*Attorney, Agent, or Firm*—W. Thad Adams, III

[57] ABSTRACT

A seating cluster for airport and similar seating areas, comprising a table positioned on a supporting surface, with six seats attached to and supported by the table adjacent each other in spaced-apart relation above the supporting surface. Each of the seats have a seat bottom having a front edge, opposed sides and a seat back. Each of the six seats are attached to the table with the front of its seat bottom positioned at an oblique angle to the front of a seat bottom of a first adjacent seat whereby each seat and its respective first adjacent seat are angled slightly to each other to facilitate conversation by occupants. Each of the six seats are positioned seat back-to-seat back with a second adjacent seat whereby occupants of each seat and the second adjacent seat are seated substantially back-to-back.

17 Claims, 6 Drawing Sheets

SEATING CLUSTER FOR AIRPORT WAITING AND SIMILAR AREAS

TECHNICAL FIELD AND BACKGROUND OF THE INVENTION

This invention relates to a seating cluster for airport waiting and similar areas, and to a seating area formed from the clusters in a particular arrangement. While seating clusters according to the present invention may be used in bus stations, train stations, hotel waiting areas and other areas, reference to airport waiting areas will be used in this application merely for purposes of illustration. The invention results from studies into seating utilization in airport waiting areas, particularly at boarding gates. Such waiting areas are generally designed with a number of rows of seats. There may be as many as 20 or 30 seats in a row, with five to 10 rows to provide sufficient seating to accommodate passengers awaiting embarkation. Adjacent rows are usually back-to-back, so that a long row of occupants face an equally long row of occupants across a narrow aisle. Generally, these rows of seats are designed to that occupants share arm rests. This creates a situation where either one occupant takes up the entire arm rest, or adjacent occupants jockey their arms and elbows to acquire arm rest space.

Studies have shown that even in crowded airports, only about 60% of the seats in the prior art types of seating area arrangements are actually used for seating. This results from the fact that approximately 70% of all airline passengers are travelling alone and prefer not to sit in very close proximity to strangers. The rest of the seats are used to hold luggage or to provide space between passengers, particularly strangers. It has been observed that many passengers will stand off to the side of the seating area or in aisles rather than sit immediately next to strangers. In addition, these prior art seating areas usually do not provide space for luggage to be placed near the owner. If the luggage is not placed in a nearby seat thereby depriving another of a place to sit, the luggage will be placed in or at the end of an aisle, creating obstacles to free movement within the area and the possibility for stumbling and tripping of passengers over the obstacles.

If these problems are addressed at all, it generally involves providing larger areas. However, it has been observed that adding additional seats does not solve the problem, since only 60% of any added seats will generally be occupied. Interaction between individuals in public places, particularly strangers, is controlled by deeply ingrained customs of which individuals are usually not even aware. Concepts such as "space" and an avoidance of touching between and among individuals in public places have not been adequately recognized or taken into account. For various reasons these factors seem to be more important to Americans than to many other nationalities.

Prior art seating areas for airports also do not accommodate needs and preferences of families, friends and business associates traveling together. Most passengers traveling with acquaintances travel in groups of two. In prior art seating areas, such individuals are forced either to sit next to each other looking straight ahead, or across an aisle from each other. If sitting next to each other, they must turn towards each other to comfortably establish eye contact needed for conversation. If sitting across a relatively wide aisle from each other, they must speak over the conversation of others and at a volume which eliminates any privacy. Since each low row of seats has an equally long aisle between it and an adjacent row, with only two ends of the row for exiting, there is a continual flow of traffic between the seats, making conversation even more difficult.

Prior art seating arrangements do not provide any nearby table areas for food or drinks, newspapers or magazines, or for telephones, reading lights, ash trays or other conveniences. Very often, seat occupants place drink cups and food on the floor near the seat. These get kicked over, creating unsanitary conditions and increasing maintenance and replacement costs. Prior art seating arrangements also do not provide access or parking facilities for wheelchairs.

For all of these reasons, a new concept in public seating has been developed which solves these problems. In so doing, it is believed that more compact seating areas can be designed which will nevertheless respect privacy and result in more comfortable short term seating.

SUMMARY OF THE INVENTION

Therefore, it is an object of the invention to provide a seating cluster which provides a compact seating area for public areas such as airport waiting areas.

It is another object of the invention to provide a seating cluster which provides an area for luggage storage adjacent the seat where the owner is seated without using another seat.

It is another object of the invention to provide a seating cluster which provides a seating arrangement for two individuals traveling together to face each other at an angle comfortable for private conversation.

It is another object of the invention to provide a seating cluster which provides ample space for passengers feet.

It is another object of the invention to provide a seating cluster which increases seating occupancy rates.

It is another object of the invention to provide a table next to each seat in a seating cluster for occupant use.

It is another object of the invention to provide a seating cluster which can be arranged in a geometric pattern which provides luggage storage space, foot space, adequate aisles for passage and space or proximity between passengers according to preference.

It is another object of the invention to provide a seating cluster which has segmented parts which can be separated if necessary to fill in odd-shaped areas such as corners.

It is another object of the invention to provide a seating cluster which provides aisles permitting entry and exit in several different directions and by several different paths.

It i s another object of the invention to provide a seating cluster which provides two arm rests for each seat occupant.

It is another object of the invention to provide a seating cluster which can be securely positioned without permanent attachment to the floor, for ease of movement for re-arrangement or when cleaning or maintaining the floor.

It is another object of the invention to provide a seating cluster which, when combined with at least two other like seating clusters permits conversation between six individuals, all of whom are facing each other at a comfortable distance from each other.

It is another object of the invention to provide a seating cluster, which, when arranged in a grouping provides space for wheelchair parking without blocking aisle access.

It is another object of the invention to provide a seating cluster which can be broken down into a cluster having either two or four seats.

These and other objects of the present invention are achieved in the preferred embodiments disclosed below by providing a seating cluster for airport and similar seating areas, comprising a table positioned on a supporting surface, with six seats attached to and supported by the table adjacent each other in spaced-apart relation above the supporting surface. Each of the seats have a seat bottom having a front edge, opposed sides and a seat back. Each of the six seats are attached to the table with the front of its seat bottom positioned at an oblique angle to the front of a seat bottom of a first adjacent seat whereby each seat and its respective first adjacent seat are angled slightly to each other to facilitate conversation by occupants. Each of the six seats are positioned seat back-to-seat back with a second adjacent seat whereby occupants of each seat and the second adjacent seat are seated substantially back-to-back.

Preferably, the sides of each of the seats and the second adjacent seat are obliquely angled to each other to define a recessed area for placement of personal possessions such as luggage and the table comprises three sides.

Preferably, the table has three primary joined sides to define a triangular-shaped table.

According to one preferred embodiment of the invention, the two seats are attached to each of the three primary sides in back-to-back relation to each other.

According to another preferred embodiment of the invention, each of the three primary sides are slightly concave.

According to yet another preferred embodiment of the invention, each of the three primary sides comprise first and second side segments oblique to each other.

According to one preferred embodiment of the invention, the triangle is equilateral.

According to one preferred embodiment of the invention, the seating clusters are grouped and geometrically arranged in spaced-apart to define a seating area for airports and similar facilities.

Preferably, the geometrical placement of the seating clusters comprises a plurality of arranged seating clusters, wherein in a first direction the seating clusters extend along a first straight line and in a second direction the seating clusters extend along a second straight line diagonal to the first straight line, and further wherein the spaces between adjacent seating clusters comprise aisles.

BRIEF DESCRIPTION OF THE DRAWINGS

Some of the objects of the invention have been set forth above. Other objects and advantages of the invention will appear as the invention proceeds when taken in conjunction with the following in which.

DESCRIPTION OF THE PREFERRED EMBODIMENT AND BEST MODE

Figure 1:
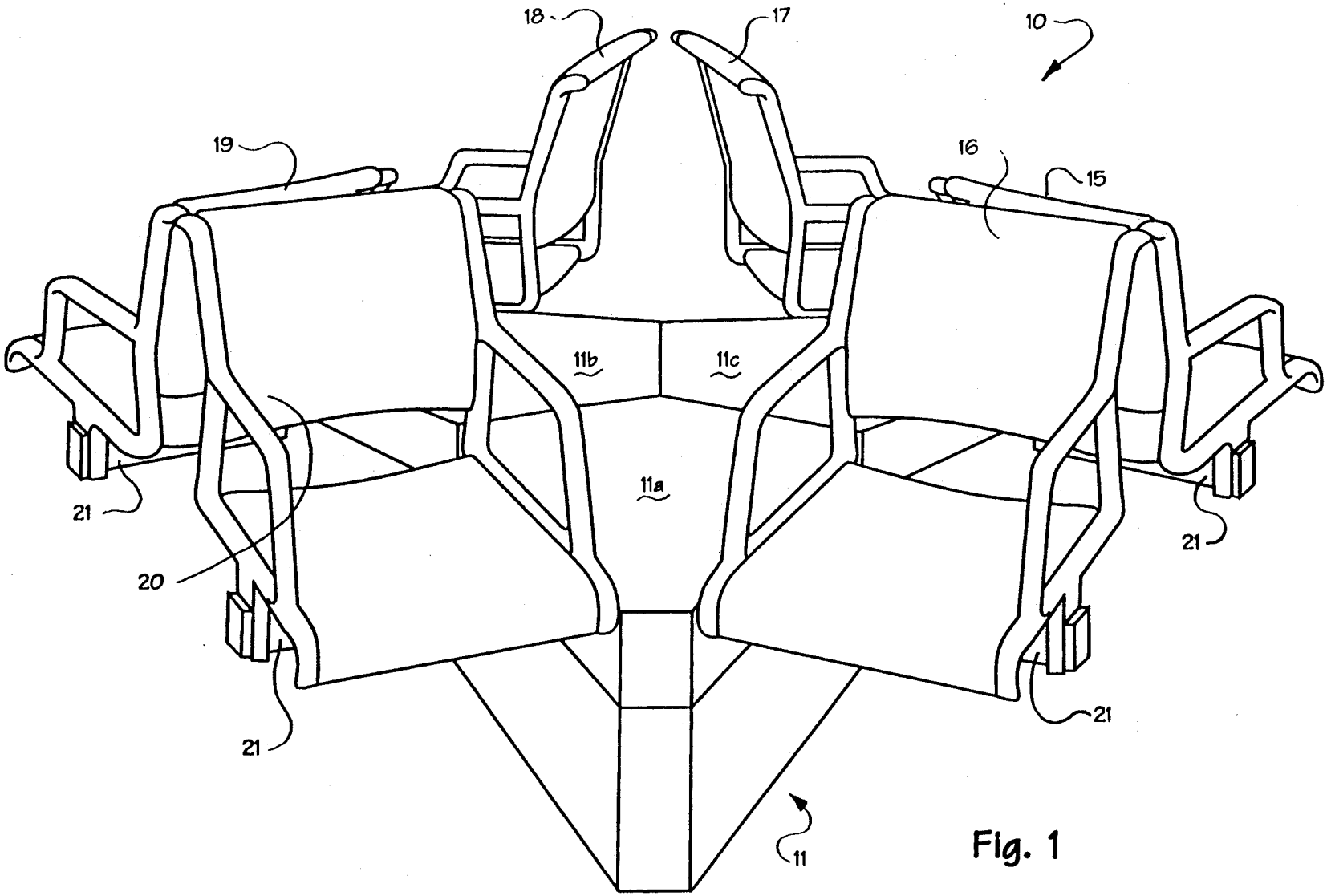
FIG. 1 is a perspective view of a seating cluster according to a preferred of the invention.

Referring now specifically to the drawings, a seating cluster according to the present invention is illustrated in FIG. 1 and shown generally at reference numeral 10. Seating cluster 10 includes a centrally-positioned table 11. Table 11 is formed as a low, solid box which sits directly on a supporting floor surface. Table 11 may be decorated to complement the overall decor of the seating area, including carpet or fabric coverings. Six seats 15 through 20 are suspended from table 10. A supporting post 21 extends outwardly from table 10 and underneath each of the seats 15–20, onto which one of the seats 15–20 is mounted. This arrangement provides a completely open space beneath each seat 15–20 for luggage storage and to permit complete and easy cleaning.

Figure 2:
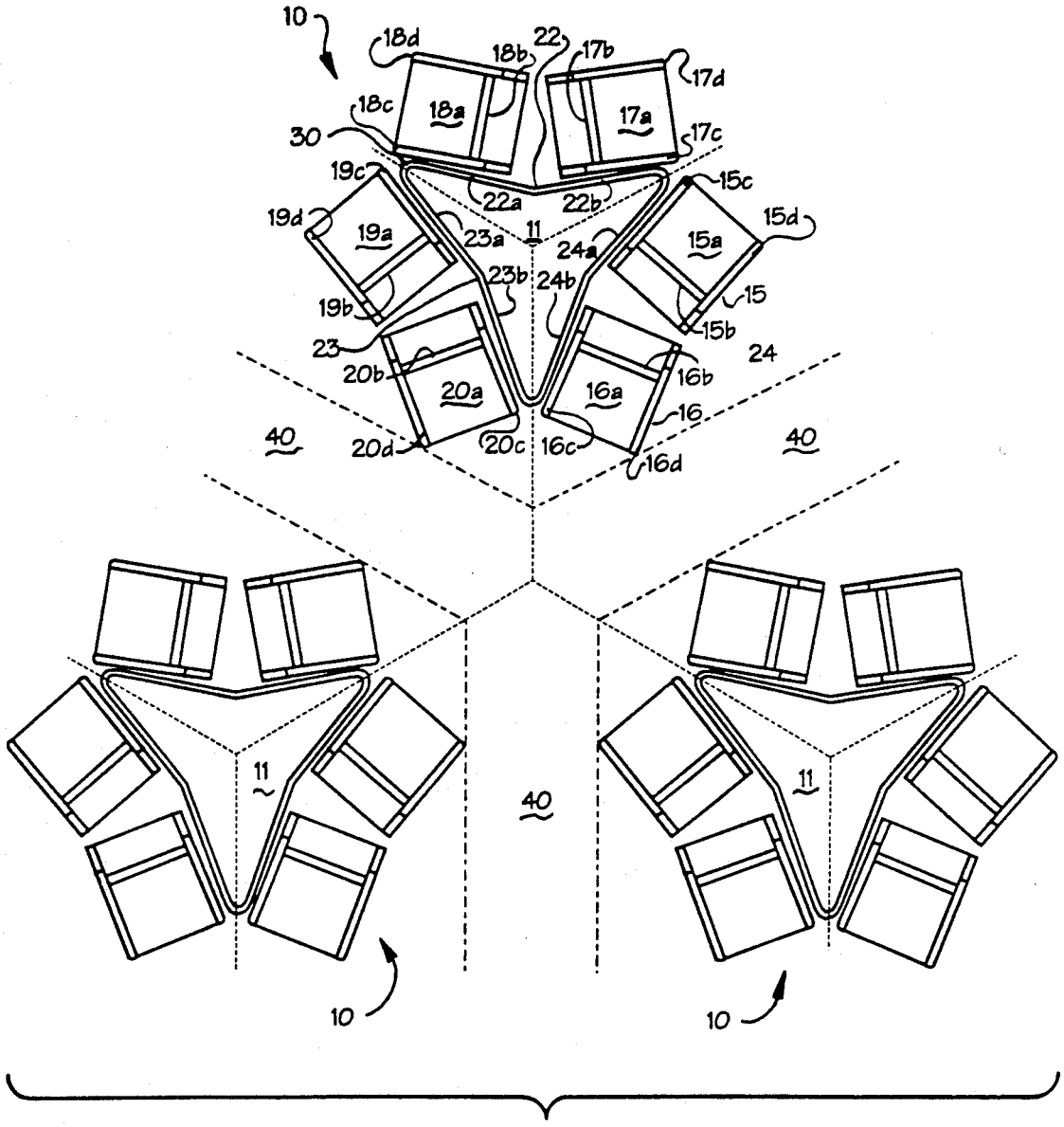
FIG. 2 is a top plan view of three of the seating clusters substantially as shown in FIG. 1, but without a segmented table.

The geometry of seating cluster 10 is more clearly shown in FIG. 2. Table 11 is substantially triangular in shape, with three equilateral sides 22, 23, and 24. Sides 22, 23 and 24 are each formed of two side segments **22*a*, 22*b*; 23*a*, 23*b*; and 24*a*, 24*b*, respectively. Side segments 22*a*, 22*b*; 23*a*, 23*b*; and 24*a*, 24*b* are angled to the side segment of the same respective side 22, 23 or 24 at a very shallow oblique angle. As is shown in FIG. 2, seats 15 and 16 are attached to side 24 of table 11, seats 17 and 18 are attached to side 22 of table 11, and seats 19 and 20 are attached to side 23**, also in such a manner as to define a very shallow oblique angle. The areas formed by these shallow angles provide sufficient space to place several pieces of luggage. See area noted at reference "Bag storage Space."

Each seat 15–20 has a seat bottom **15*a*–20*a*, respectively; a seat back 15*b*–20*b*, respectively, two opposed arm rests 15*c*,15*d*–20*c*–20*d***.

The geometry of the seating cluster 10 provides two distinct types of paired groupings of seats. One paired grouping comprises, for example, any seat and a first other seat which it backs up to so that occupants of these seats will be back-to-back to each other. These groupings are 15, 16; 17, 18 and 19, 20, respectively and thus provide three pairs of seats per cluster. These seats could be occupied by strangers with a feeling of privacy from each other despite relatively close proximity, particularly since each seat is separated from every other seat by a portion of the table 11.

Another grouping of the seats comprises any seat and a second other seat which it is angled towards so that the front of the seat bottoms are at a shallow, oblique angle to each other. These groupings are 15, 17;, 18, 19; and 20, 16, respectively. These seats can be occupied by passengers traveling together. The occupants face slightly towards each other for ease of conversation and are close enough for private conversation at a moderate voice level. Again, the table 11 provides enough distance between adjacent seat occupants to permit comfortable conversation. Furthermore, table 11 provides sufficient distance between the seats so that strangers consider the each seat to be a single seat.

Figure 6:
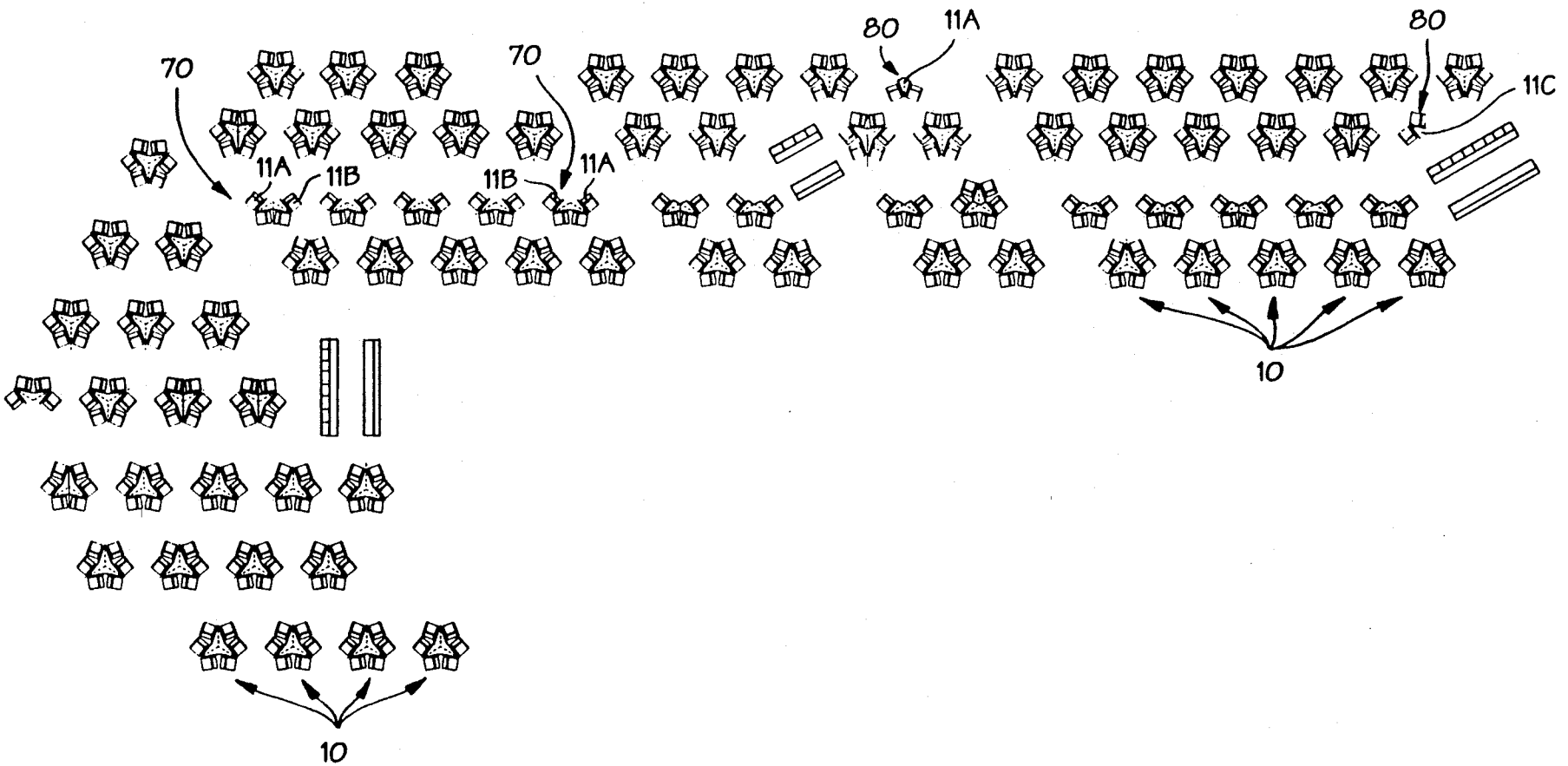
FIG. 6 is a top plan view of an airport boarding area showing uses of the cluster in two, four and six seat configurations.

Table 11 is adaptable to variety of uses. Lamps, ash trays, telephones, cup holders and the like can be provided for the occupants. A raised rim 30 around the periphery of the table 11 can be added to contain spills. Up-directed lighting can be incorporated into the center of each table to provide reading light. In addition, table 11 can be formed in three uniform segments 11*a*, 11*b*, 11*c*, as shown in 1. When necessary or desireable, either one, two or three table segments 11*a*, 11*b*, or 11*c* with the attached seats can be placed in corners, against walls or in other places where the full seat cluster 10 will not fit. This is shown in FIG. 6, where seating clusters 70, comprising segments 11*a* and 11*b*, are joined together, and seating clusters 80, comprising only a single segment 11*a*, are used to fill odd-sized and undersized spaces, and to provide more room along aisles. This is particularly important as a means of providing access for wheelchairs and extra space for the handicapped, those with baby strollers, large luggage carriers or several bags. Wheelchairs and baby strollers can be easily moved through the aisles and parked in one of the recesses next to another seat. Each separate seating cluster provides a suitable space for parking a wheelchair or the like. If desired, seating clusters 70 or 80 can be specifically arranged and positioned near an exit or to the side to accommodate a wheelchair.

Figure 3:
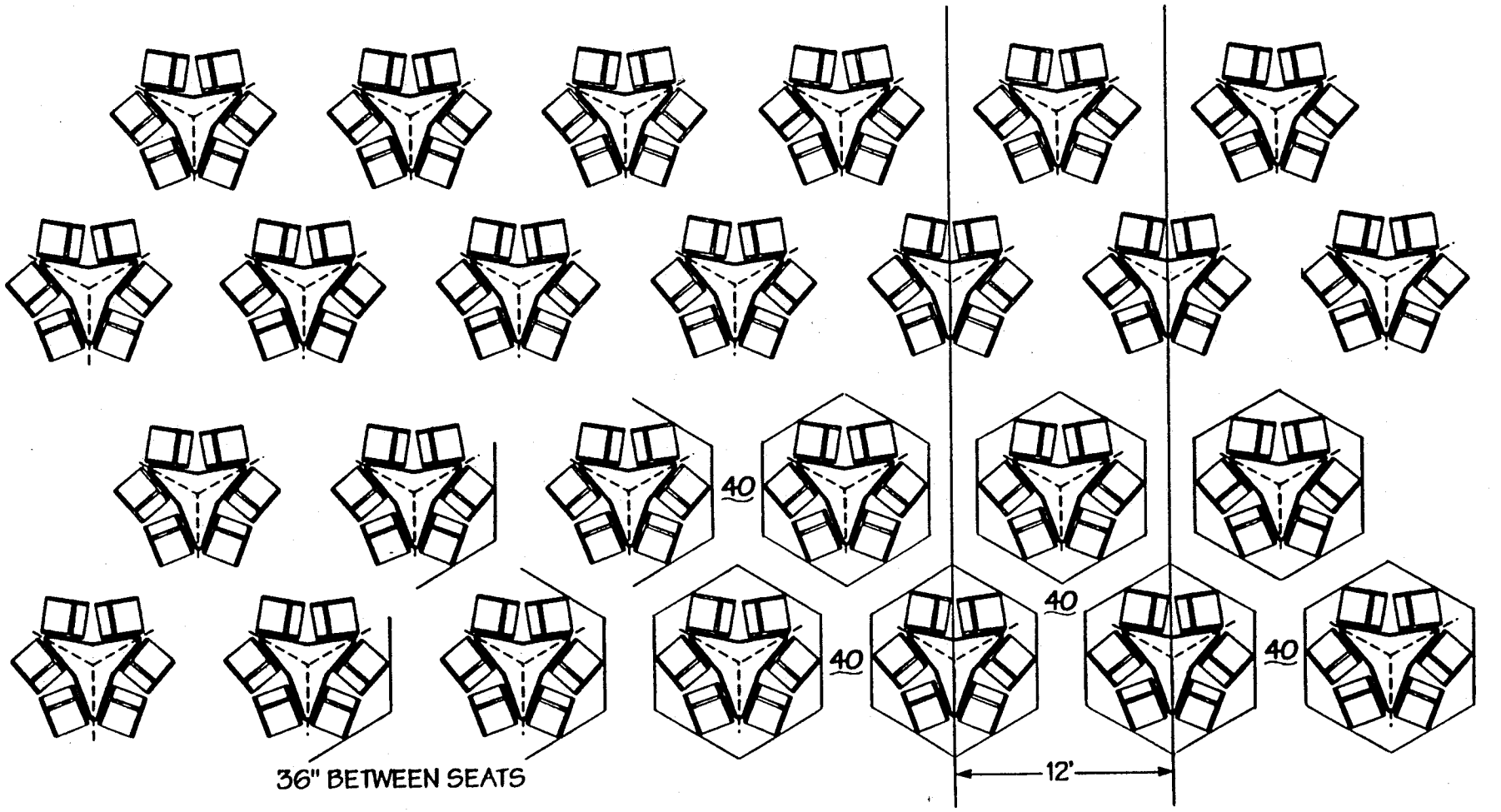
FIG. 3 is a seating area formed of a plurality of seating clusters with 36 inch spacing between seats.
Figure 4:
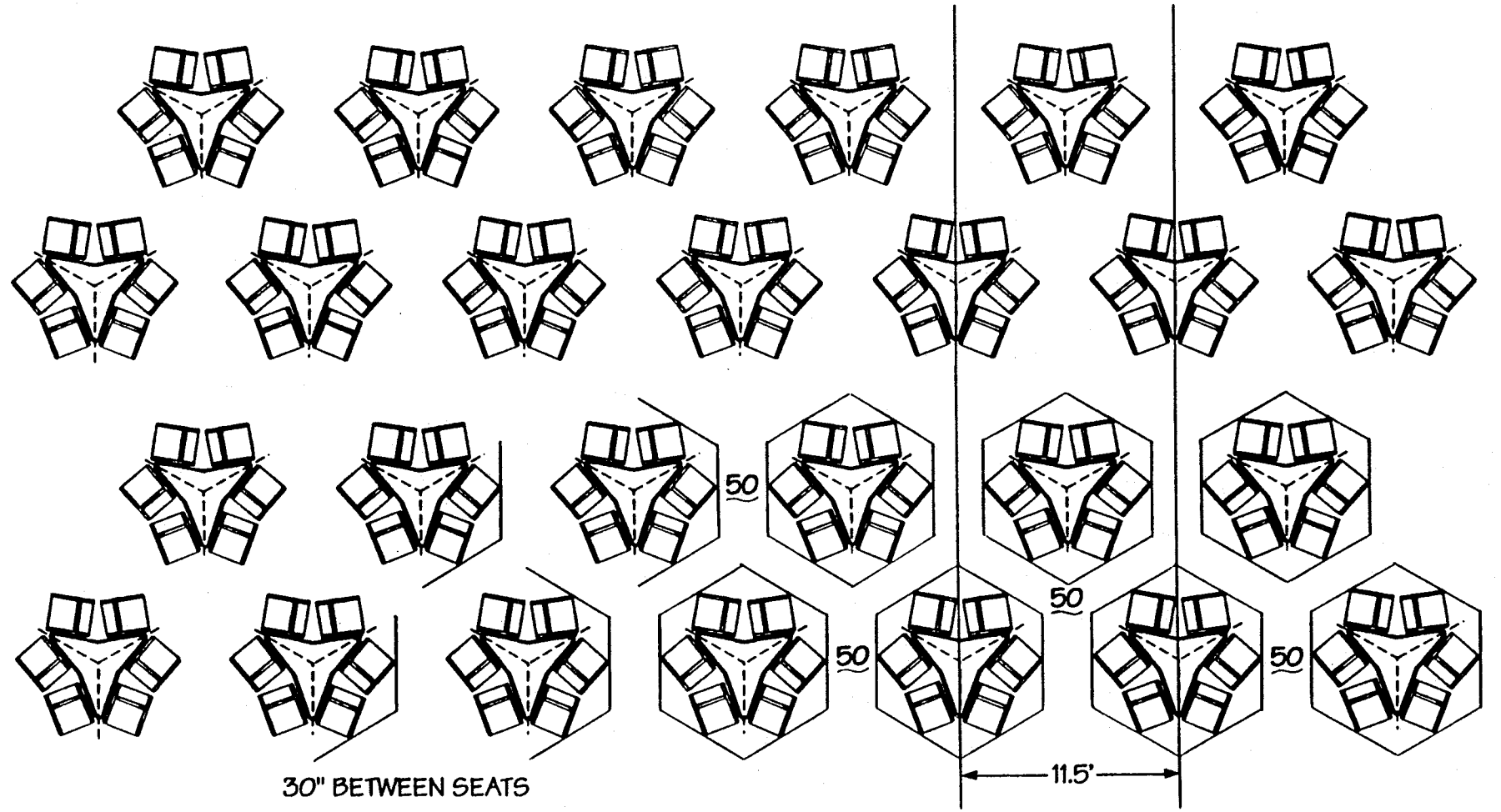
FIG. 4 is a seating area formed of a plurality of seating clusters with 30 inch spacing between seats.
Figure 5:
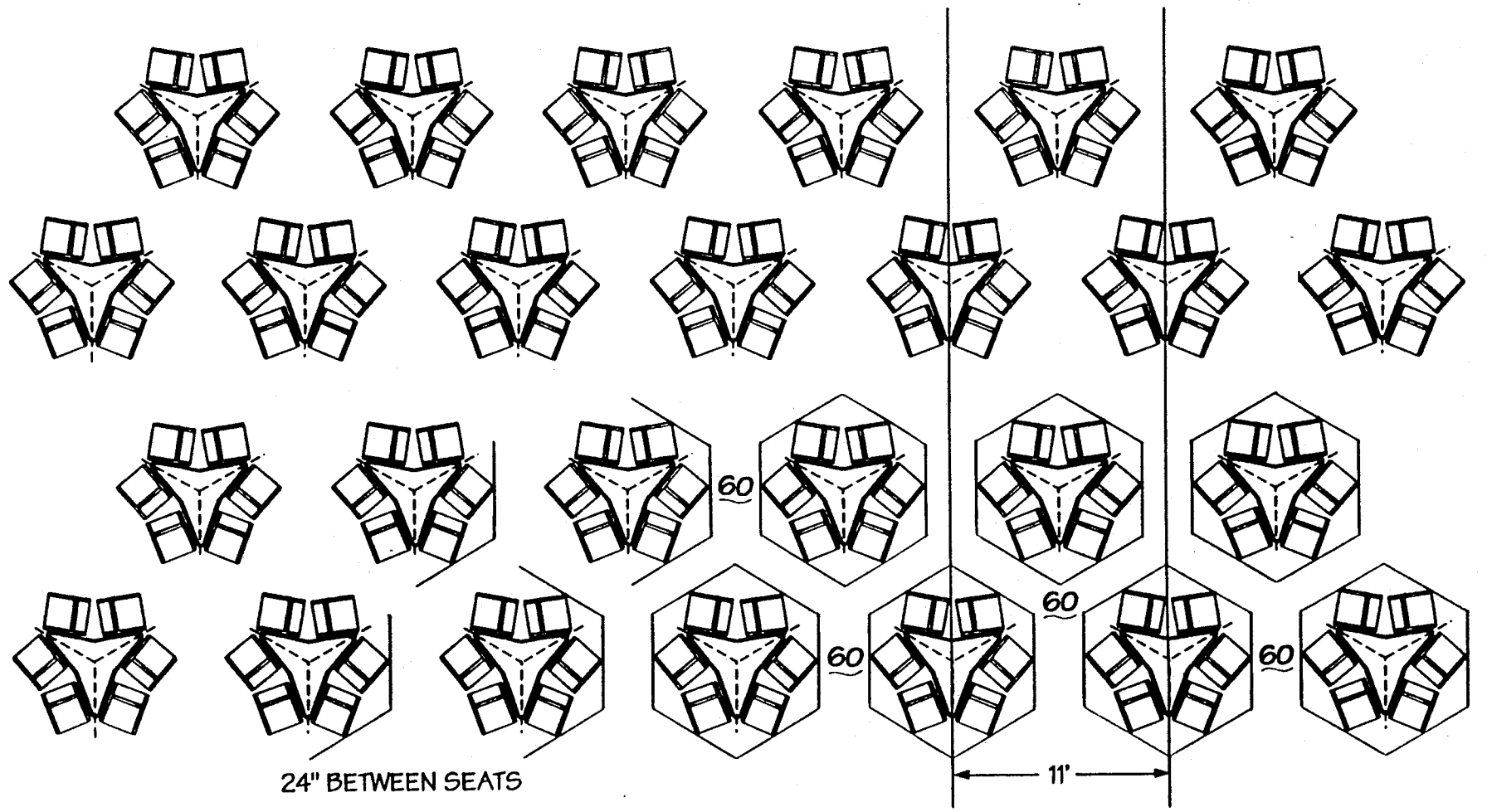
FIG. 5 is a seating area formed of a plurality of seating clusters with 24 inch spacing between seats.

As is also shown in FIGS. 2 and 3, seating clusters 10 are placed in a geometric pattern which provides aisles 40 which jog slightly as they traverse each seating cluster 10. Three different seating cluster arrangements are shown in FIGS. 3, 4 and 5. In FIG. 3, 36 inches are provided in aisle 40 between adjacent seats of adjacent seating clusters 10.

In FIG. 4, aisles 50 provide 30 inches between adjacent seats of adjacent seating clusters 10.

In FIG. 5, aisles 60 provide 24 inches between adjacent seats of adjacent seating clusters 10.

A seating cluster is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A seating cluster for airport and similar seating areas, comprising:

(a) a table for being positioned on a supporting surface;

(b) six seats attached to and supported by the table in spaced-apart relation to each other about the perimeter of the table in spaced-apart relation above the supporting surface thereby defining a luggage storage area underneath the seat bottom, each of said seats having a seat bottom having a front edge, opposed inner and outer sides and a seat back;

(c) each of said six seats attached to said table adjacent their respective inner side with the front of their respective seat bottoms positioned at an obtuse angle to the front of a seat bottom of a side adjacent seat whereby each seat and its respective side adjacent seat are angled slightly to each other to facilitate conversation by occupants and the outer side of each of said seats are adapted to define an aisle for occupant passage; and (d) each of said six seats positioned back-to-seat back with a rear adjacent seat whereby occupants of each seat and the rear adjacent seat are seated substantially back-to-back, the seat backs of said each seat and said rear adjacent seat defining an acute angle relative to each other.

2. A seating cluster according to claim 1, wherein the outer sides of each of said seats and said rear adjacent seat are obtusely angled to each other to define a recessed area for placement of personal possessions such as luggage.

3. A seating cluster according to claim 1, wherein said table comprises three sides.

4. A seating cluster according to claim 3, wherein said table has three separable identical seating cluster segments, each said segment having a primary side, whereby said primary sides are joined together to define a triangular spaced table.

5. A seating cluster according to claim 4, wherein two seats are attached to each of the three primary sides in back-to-back relation to each other.

6. A seating cluster according to claim 5, wherein each of said three primary sides are slightly concave.

7. A seating cluster according to claim 6, wherein each of said three primary sides comprise first and second side segments obtusely angled relative to each other.

8. A seating cluster according to claim 4, wherein each of said seats has two individual arm rests.

9. A seating for airports and similar facilities, said seating area comprising a plurality of geometrically placed, spaced-apart seating clusters, each of said seating clusters comprising:

(a) a table for being positioned on a supporting surface;

(b) six seats attached to and supported by the table in spaced-apart relation to each other about the perimeter of the table in spaced-apart relation above the supporting surface thereby defining a luggage storage area underneath the seat bottom, each of said seats having a seat bottom having a front edge, opposed inner and outer sides and a seat back;

(c) each of said six seats attached to said table adjacent their respective inner sides with the front of their respective seat bottoms positioned at an obtuse angle to the front of a seat bottom of a side adjacent seat whereby each seat and its respective conversation by occupants and the outer side of each of said seats is adapted to define an aisle between adjacent seating clusters for occupant passage; and (d) each of said six seats positioned seat back-to-back with a rear adjacent seat whereby occupants of each seat and the rear adjacent seat are seated substantially back-to-back, the seat backs of said each seat and rear adjacent seat defining an acute angle relative to each other.

10. A seating area according to claim 9, wherein the outer sides of each of said seats and said rear adjacent seat are obtusely angled to each other to define a recessed area for placement of personal possessions such as luggage.

11. A seating area according to claim 9, wherein said table comprises three sides.

12. A seating area according to claim 11, wherein said table has three separable identical seating cluster segments, each said segment having a primary side, whereby said primary sides are joined together to define a triangular shaped table.

13. A seating area according to claim 12, wherein two seats are attached to each of the three primary sides in back-to-back relation.

14. A seating area according to claim 13, wherein each of said three primary sides are slightly concave.

15. A seating area according to claim 14, wherein each of said three primary sides comprise first and second side segments obtusely angled relative to each other.

16. A seating area according to claim 12, wherein said triangular-shape table is equilateral.

17. A seating area according to claim 9, wherein said geometrical placement of said seating clusters comprises a plurality of arranged seating clusters, wherein in a first direction said seating clusters extend along a first straight line and in a second direction said seating clusters extend along a second straight line diagonal to said first straight line, and further wherein the spaces between adjacent seating clusters comprise aisles.

* * * * *